US010180301B2

(12) United States Patent
Hogue

(10) Patent No.: US 10,180,301 B2
(45) Date of Patent: Jan. 15, 2019

(54) FIREARM BEAVERTAIL GRIP SLEEVE

(71) Applicant: Hogue, Inc., Henderson, NV (US)

(72) Inventor: Matthew Allen Hogue, Atascadero, CA (US)

(73) Assignee: HOGUE, INC., Henderson, NV (US)

( * ) Notice: Subject to any disclaimer, the term of this patent is extended or adjusted under 35 U.S.C. 154(b) by 0 days.

(21) Appl. No.: 15/910,202

(22) Filed: Mar. 2, 2018

(65) Prior Publication Data

US 2018/0347938 A1 Dec. 6, 2018

Related U.S. Application Data

(60) Provisional application No. 62/512,242, filed on May 30, 2017.

(51) Int. Cl.
*F41C 23/10* (2006.01)
*F41C 23/18* (2006.01)

(52) U.S. Cl.
CPC ..... *F41C 23/10* (2013.01); *F41C 23/18* (2013.01)

(58) Field of Classification Search
CPC ..... F41C 23/10
USPC ..... 42/71.02
See application file for complete search history.

(56) References Cited

U.S. PATENT DOCUMENTS 1,049,739 A * 1/1913 Leach, Jr. ..... F41C 23/10 42/71.02
4,286,401 A * 9/1981 Pachmayr ..... F41C 23/10 42/71.02
D351,448 S * 10/1994 Fisher ..... 42/71.02
8,950,098 B2 * 2/2015 Sims ..... F41C 23/10 42/1.06

FOREIGN PATENT DOCUMENTS

FR 2559251 A1 * 8/1985 ..... F41C 23/10

OTHER PUBLICATIONS

Hogue, Inc., "Handall Hybrid Ruger LCP Grip Sleeve Black," https://www.hogueinc.com/handall-hybrid-ruger-lcp-grip-sleeve-black, (c) 2017, Accessed Feb. 2, 2018.
Hogue, Inc., "Handall Hybrid Taser Conducted Electrical Weapon Grip Sleeve—Fits Models X26, X26P, X2," https://www.hogueinc.com/handall-hybrid-taser-conducted-electrical-weapon-grip-sleeve-fits-models-x26-x26p-x2-black, (c) 2017, Accessed Feb. 2, 2018.
Hogue, Inc., "Handall Hybrid S&W M&P 9MM, 40S&W, 357SIG Grip Sleeve Pink," https://www.hogueinc.com/handall-hybrid-s-w-m-p-9mm-40s-w-357sig-grip-sleeve-pink, (c) 2017, Accessed Feb. 2, 2018.

(Continued)

*Primary Examiner* — Reginald S Tillman, Jr.
(74) *Attorney, Agent, or Firm* — Bennet K. Langlotz; Langlotz Patent & Trademark Works, Inc.

(57) ABSTRACT

A firearm beavertail grip sleeve has a tubular body having a front wall, a left side wall, and a rear wall, the body being of an elastomeric material, the body having a lower end associated with the lower free end of the pistol grip, and an opposed upper end, the upper end of the body having a front edge portion at the front surface at a limited first vertical distance above the lower end, the upper end of the body having a rear edge portion at the rear surface at a second vertical distance above the lower end greater than the first vertical distance, and at least a upper guard element at the upper end of the rear edge portion curving back in an upward and rearward direction. The upper guard element may have a guard surface facing in a direction angularly rearward and downward.

18 Claims, 7 Drawing Sheets

(56) References Cited

OTHER PUBLICATIONS

Hogue, Inc., "AR-15/M-16 Rubber Grip Beavertail with Finger Grooves Purple," https://www.hogueinc.com/ar-15-m-16-rubber-grip-beavertail-with-finger-grooves-purple, (c) 2017, Accessed Feb. 2, 2018.
Glockstore, "Beavertail Grip Adapter," http://www.glockstore.com/Beaver-Tail-Grip-Adapter, (c) 2017, 4ccessed Feb. 21, 2018.

* cited by examiner

FIREARM BEAVERTAIL GRIP SLEEVE

FIELD OF THE INVENTION

The present invention relates to grip sleeves for firearms, and more particularly to a device that enhances the functionality of the standard factory-supplied firearm frame/grip by creating a barrier between the frame/grip and hand to add comfort, control, and sight alignment.

BACKGROUND OF THE INVENTION

It is often desirable to utilize firearm grip sleeves composed of rubber or other relatively soft elastomers in conjunction with standard factory-supplied firearm frame/grips for handguns. The use of a soft firearm grip sleeve assembly provides the user with a more secure grip. Such firearm grip assemblies often include ergonomic features such as finger ridges and palm swells to provide adequate security for holding the gun during recoil. The firearm grip assemblies may also provide a larger grip circumference than the standard factory-supply firearm grip to accommodate users with larger hands.

Elastomeric grip sleeves have limitations pertaining to how much coverage can be accomplished while maintaining an adequate attachment to the firearm. How far the sleeve is extended in any one direction has been traditionally limited by the assumption that the grip sleeve must stretch under tension to achieve the required support. As a result, conventional elastomeric grip sleeves have left the beavertail area of the host firearm uncovered. The beavertail area is where the web of the user's hand between the thumb and index finger is in contact with the firearm.

Various grip sleeves have been developed to provide coverage of the beavertail region of the firearm. However, these have included a hard rigid plastic portion as a support and sometimes are mechanically locked to the firearm using one of the firearm's pins. These features can make the prior art grip sleeves less comfortable to grip, more difficult to install, and more expensive to manufacture than a grip sleeve entirely formed only of an elastomeric material.

Therefore, a need exists for a new and improved firearm beavertail grip sleeve that provides a barrier between the frame/grip and hand to add comfort, control, and sight alignment. In this regard, the various embodiments of the present invention substantially fulfill at least some of these needs. In this respect, the firearm beavertail grip sleeve according to the present invention substantially departs from the conventional concepts and designs of the prior art, and in doing so provides an apparatus primarily developed for the purpose of providing a barrier between the frame and hand to add comfort, control, and sight alignment.

SUMMARY OF THE INVENTION

The present invention provides an improved firearm beavertail grip sleeve, and overcomes the above-mentioned disadvantages and drawbacks of the prior art. As such, the general purpose of the present invention, which will be described subsequently in greater detail, is to provide an improved firearm grip sleeve with laser gunsight system that has all the advantages of the prior art mentioned above.

To attain this, the preferred embodiment of the present invention essentially comprises a tubular body having a front wall, a left side wall, and a rear wall, the body being of an elastomeric material, the body having a lower end associated with the lower free end of the pistol grip, and an opposed upper end, the upper end of the body having a front edge portion at the front surface at a limited first vertical distance above the lower end, the upper end of the body having a rear edge portion at the rear surface at a second vertical distance above the lower end greater than the first vertical distance, and at least a upper guard element at the upper end of the rear edge portion curving back in an upward and rearward direction. The upper guard element may have a guard surface facing in a direction angularly rearward and downward. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
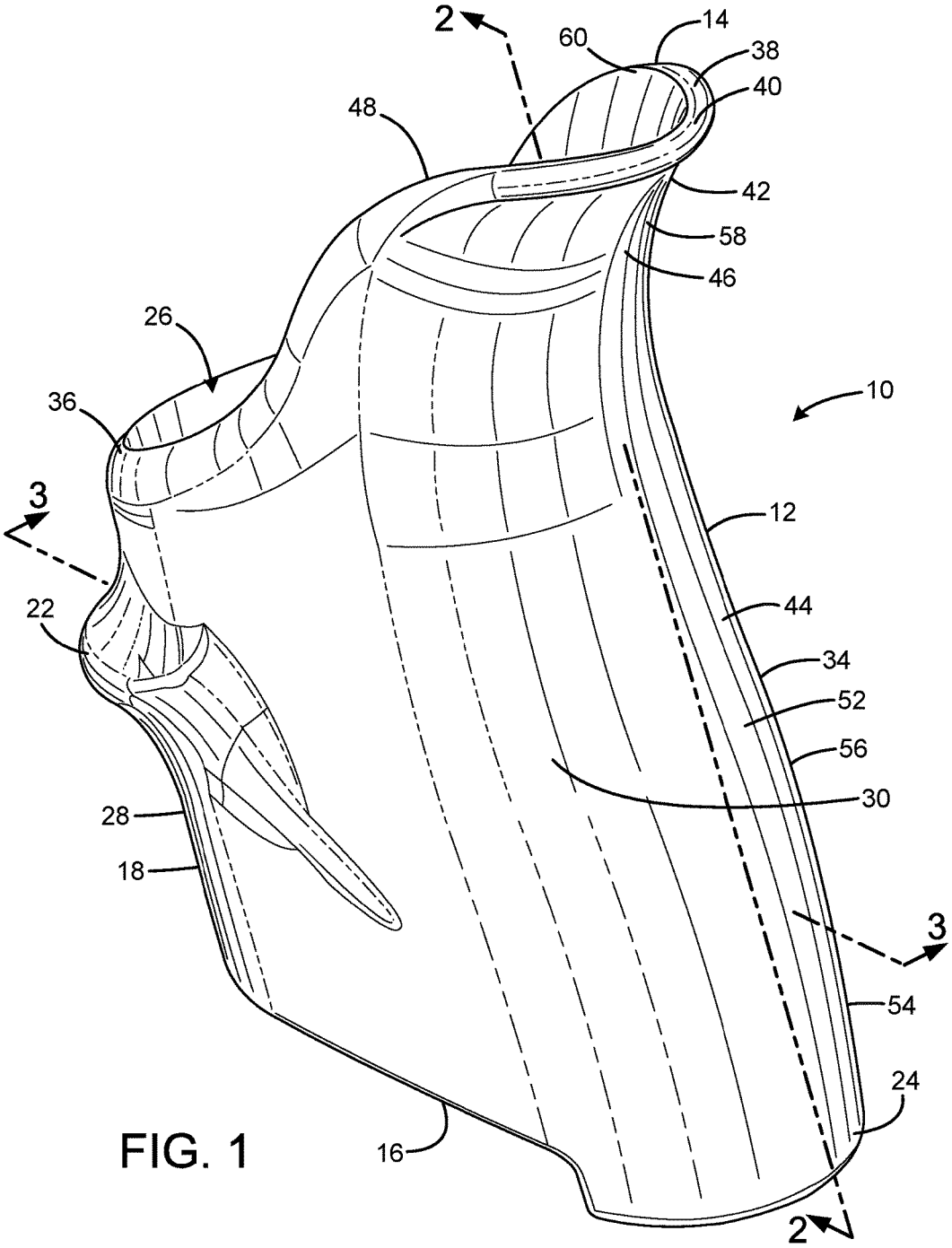
FIG. 1 is a top isometric view of the current embodiment of a firearm beavertail grip sleeve constructed in accordance with the principles of the present invention.
Figure 2:
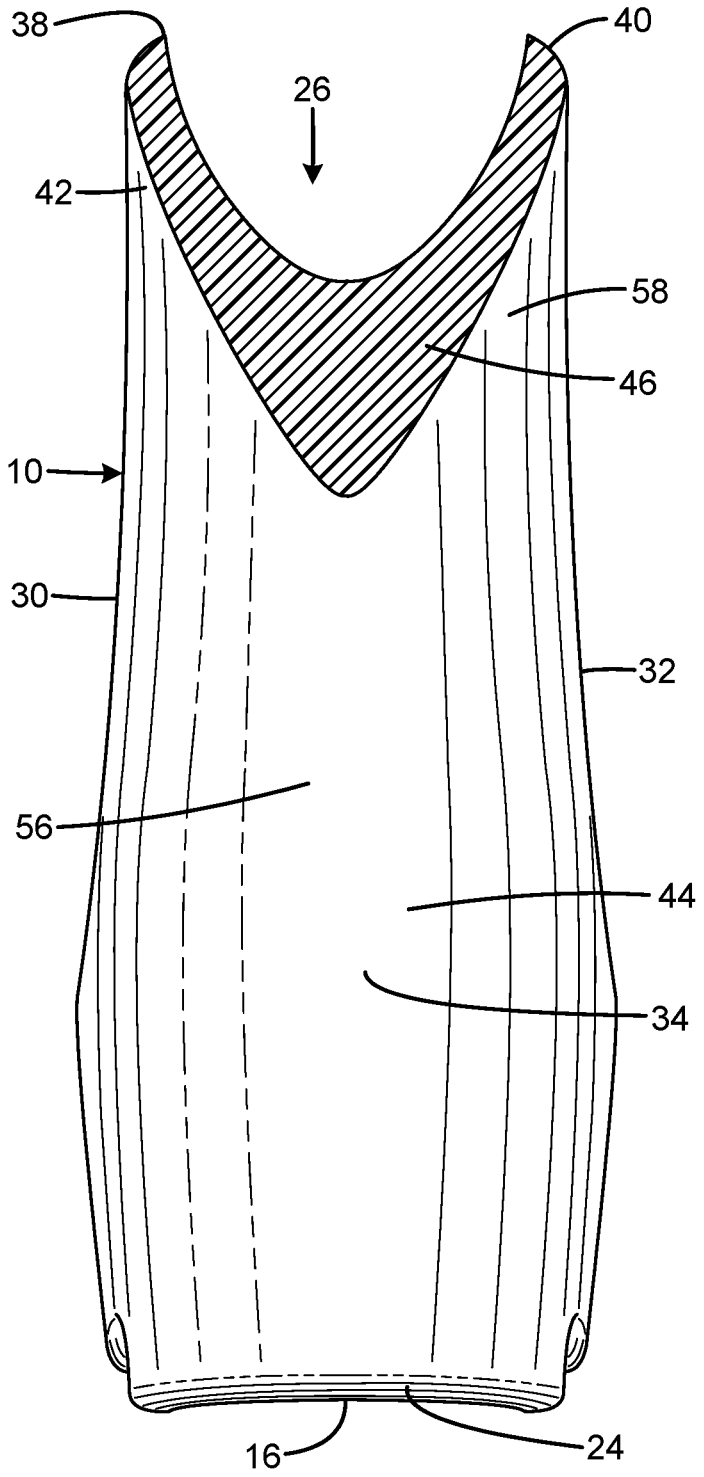
FIG. 2 is a sectional view taken along line 2-2 of FIG. 1.
Figure 3:
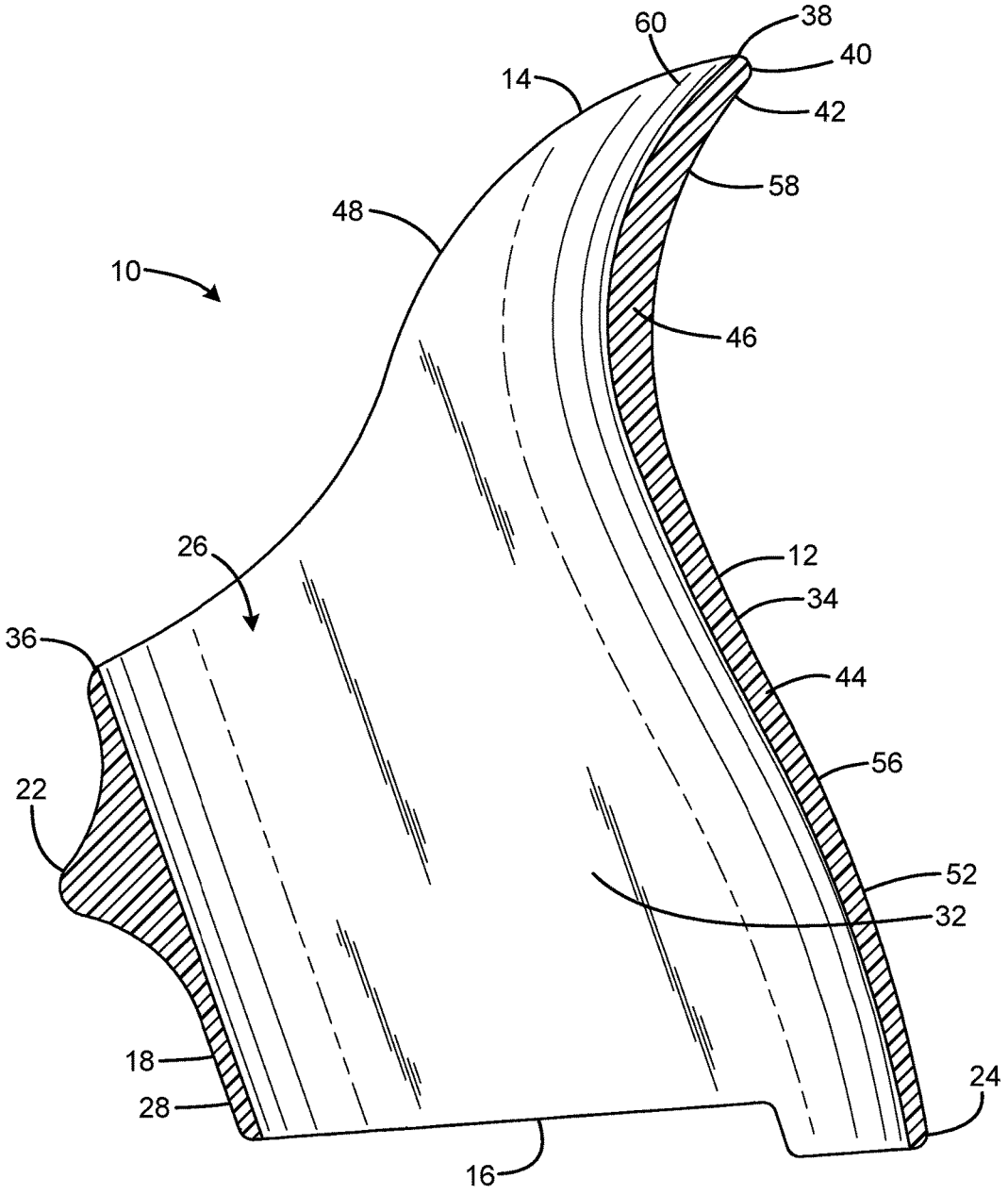
FIG. 3 is a sectional view taken along line 3-3 of FIG. 1.

An embodiment of the firearm beavertail grip sleeve of the present invention is shown and generally designated by the reference numeral 10.

FIGS. 1-4B illustrate the improved firearm beavertail grip sleeve 10 of the present invention for use with a Glock 380 pistol manufactured by Glock, Inc of Smyrna, Ga. This type of pistol has a 1-piece integrally molded plastic frame 228 including a unitary molded plastic handgrip 202 with a curved exterior to be comfortably received in a user's hand.

The firearm beavertail grip sleeve 10 of the present invention includes a tubular elongated body 12 with a central bore passage 26. The bore completely opens the top 14 and bottom 16 of the body. A heel cover 24 extends downward from the bottom 16 of the body. The body and bore of the sleeve have a generally oblong or "racetrack" cross-section so the bore can closely receive the handgrip 202 of the pistol 200. The heel cover is shaped to closely fit over the heel 230 of the pistol, while the bottom of the sleeve is shaped to avoid obstructing the pistol's magazine well. A ridge 22 extends from the front 18 of the body. The ridge defines grooves on either side of the ridge that receive the user's fingers 50 when the pistol 200 is held in a firing position. In the current embodiment, the sleeve is entirely formed entirely/only of a single/unitary elastomeric material and is free of holes other than the central bore passage defined by the tubular body.

Figure 4B:
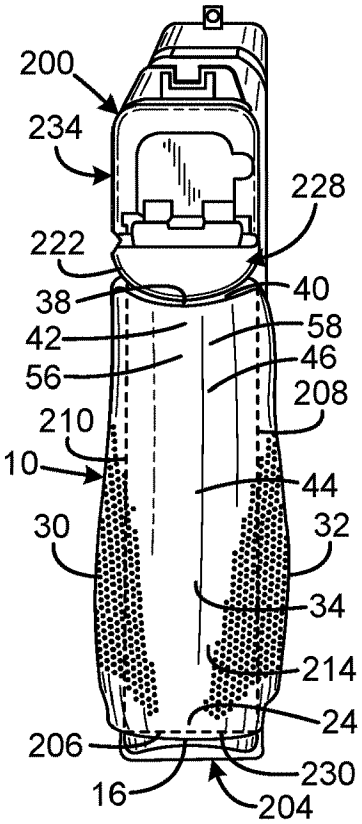
FIG. 4B is a rear view of the current embodiment of the firearm beavertail grip sleeve of FIG. 1 installed on a Glock 380 pistol.
Figure 4A:
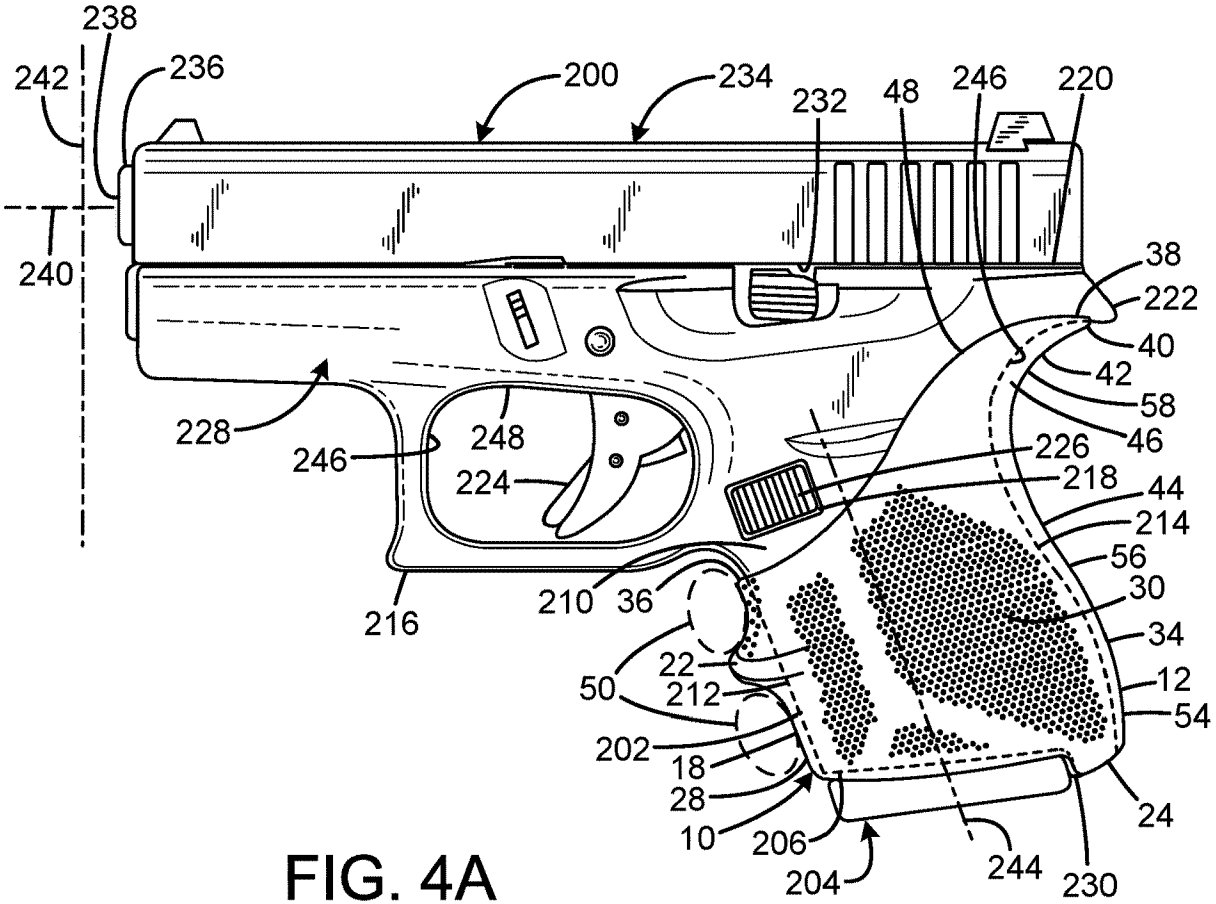
FIG. 4A is a left side view of the current embodiment of the firearm beavertail grip sleeve of FIG. 1 installed on a Glock 380 pistol.

The Glock 380 pistol 200 shown in FIGS. 4A and 4B has a downwardly-extending handgrip 202 that angles slightly rearward and is a tubular body defining an elongated well (not visible) capable of closely receiving a removable magazine 204. The handgrip has a lower free end 206. The grip has flat or gently curved right and left side portions 208, 210, a straight semi-cylindrical front strap surface 212 facing forward, and a curved back strap surface 214 facing rearward. The handgrip generally has an oblong, oval or "racetrack" cross-section. The handgrip has a curved and continuous surface to provide a secure comfortable grip, in the manner of any pistol. At the upper end of the front strap, a trigger guard 216 projects forward and upward relative to the handgrip to protect the trigger 224 from accidental activation. A magazine release 226 protrudes transversely from the top left side portion of the handgrip through a magazine release aperture 218. The back strap extends nearly to the upper edge 220 of the frame 228, curving rearward at its upper portion. A beavertail protrusion portion 222 of the frame protrudes and curves in a rearward direction at the upper end of the back strap. The beavertail protrusion portion extends rearward from and above a forward rear grip surface 246. The lower edge 232 of a slide 234 is located immediately above the upper edge of the frame. The slide reciprocates with respect to the pistol during chambering of cartridges and ejection of casings. The slide includes a barrel 236 having a muzzle 238. The barrel defines a horizontal axis 240 and a perpendicular vertical axis 242.

The tubular body 12 of the firearm beavertail grip sleeve 10 has a front wall 28, left side wall 30, right side wall 32, and rear wall 34. The body has a lower end/bottom 16 associated with the lower free end 206 of the handgrip 202 and an opposed upper end/top 14. The upper end of the body has a front edge portion 36 at the front wall at a limited first vertical distance above the lower end. The upper end of the body has a rear edge portion 38 at the rear wall at a second vertical distance above the lower end greater than the first vertical distance. The rear edge portion overlays and is below at least a portion of the beavertail protrusion portion/frame element 222. The rear edge portion has an upper surface 60 abutting the beavertail frame element. In the current embodiment, the upper surface faces in a direction at least in part upward. There is at least an upper guard element 40 at the upper end of the rear edge portion of the body curving back in an upward and rearward direction. The upper guard element has a guard surface 42 facing in a direction angularly rearward and downward. In the current embodiment, the upper guard element is a saddle shape having a positive curvature.

The rear wall 34 of the tubular body 12 has a cross-sectional thickness of a first thickness at an intermediate portion 44 below the upper guard element 40, and a greater second thickness at the upper guard element at the location denoted by 46. The upper end 14 has an upper perimeter 48 forward of the upper guard element having a convex curvature adjacent to the upper guard element and a concave curvature away from the upper guard element akin to a cyma recta. The front edge portion 36 is spaced below the trigger guard 216 to enable a finger 50 below the trigger guard to contact the handgrip 202 below the trigger guard. The front edge portion is also spaced below the magazine release 226 so the magazine release is exposed to be operable by a finger. The central bore 26 of the body defines a linear grip passage defining a magazine insertion axis 244. In the current embodiment, the upper guard element extends further upward along the magazine insertion axis than does the front edge portion. The trigger guard defines an opening 246 having an upper limit 248. In the current embodiment, the upper guard element extends vertically to a level above the upper limit of the trigger guard opening. The rear wall has a rear surface 52 with a lower portion 54 angling downward and rearward, a curved transition 56 above the lower portion, and an upper portion 58 extending upward and rearward from the curved transition. In the current embodiment, the curved transition and the upper portion are a continuous curved surface.

In use, the firearm beavertail grip sleeve 10 is installed on the handgrip 202 of the pistol 200. To attach the sleeve, the lower free end 206 of the handgrip is inserted into the bore 26 through the top 14 of the sleeve. The sleeve is slid upwards until the pistol's heel 230 is covered by the heel cover 24 and the upper guard element 40 abuts the beavertail protrusion 222. In this location, the sleeve cannot easily creep further upwards longitudinally or rotate axially around the handgrip. However, the sleeve can be slid downwards to remove it from the handgrip. The elastomeric material of the upper guard element provides better comfort for the user's hand than a sleeve omitting coverage of the beavertail protrusion or a sleeve that employs a hard plastic material to cover the beavertail protrusion.

Furthermore, the firearm beavertail grip sleeve 10 attaches to the pistol 200 not only by its own resiliency, but also because of its unique shape and thickness variations of the rear wall 34 and upper guard element 40. The wall thicknesses change back and forth from thin to thick to add rigidity in the portions that abut the beavertail area 222. This is accomplished by the side walls 30, 32 of the sleeve, which are thicker due to palm swell and a natural designed ergonomic feel. The side walls reduce in wall thickness as the elastomeric material wraps along the rear wall 34 of the sleeve, and then increase in thickness to create a support spine in the rear edge portion 38 that abut the beavertail region. This spine increases in thickness from the bottom of the beavertail arc to the thickest point approximately in the center of the arc, and back to thin at the highest region of the beavertail. Along the support spine, the upper surface 60 of the rear edge portion transitions from thick to thin and then back into the thick portion of the spine. The principle is to build a surrounding integrated structure to support the rear edge portion. By having the face/sides of the rear edge portion vary from thick to thin and flowing back to the thick portion of the spine, this prevents the rear edge portion from freely moving side to side or back and forth. The rigidity of the rear edge portion accommodates many gun frame styles as it flexes and conforms to the frame shape while creating a retention fit.

The rear edge portion is semi-rigid, meaning that the rear edge portion will flex when a force is applied and return to its molded shape upon removal of the force. This semi-rigid shape accommodates many gun frame designs as the rear edge portion conforms to the frame 228 by its resiliency to change shape from its originally molded shape. The varying side wall thicknesses that wrap into the spine, and the spine itself, are the key to this action. As the frame pushes the rear edge portion away, the reinforced integrated structure of the rear edge portion pushes back against the frame for a tight fit. If this varying wall thickness structure was not built into the rear edge portion, it would become floppy and could move side to side as well as back and forth without returning to its original molded shape. While installed on a gun frame or rifle, a floppy rear edge portion would not have the ability to push back against the frame because of inadequate side wall thickness and associated resiliency and would hang loosely. This would provide an unacceptable fit and would not conform to the shape of the frame.

The usage of only a unitary elastomeric material in the current embodiment of the firearm beavertail grip sleeve 10 provides a comfortable interface between the soft material of the sleeve in the beavertail area 222 and the web of the user's hand between the user's thumb and index finger that is in contact with the pistol 200. This comfortable contact provides perceived confidence and security to the user. It also increases the coefficient of friction in the beavertail area, which gives better control and sight alignment during the recoil of the pistol than that of an ordinary grip sleeve that leaves the beavertail area uncovered. In the current embodiment, the thermoplastic elastomer used in the firearm beavertail grip sleeve has a common shore hardness of 62-63 A. However, with the multiple complex varying side wall thickness, the shore hardness of the thermoplastic elastomer can have a variance of at least 10 points and still enable the firearm beavertail grip sleeve to be able to perform its function with an acceptable fit to the frame of the host pistol.

Figure 5:
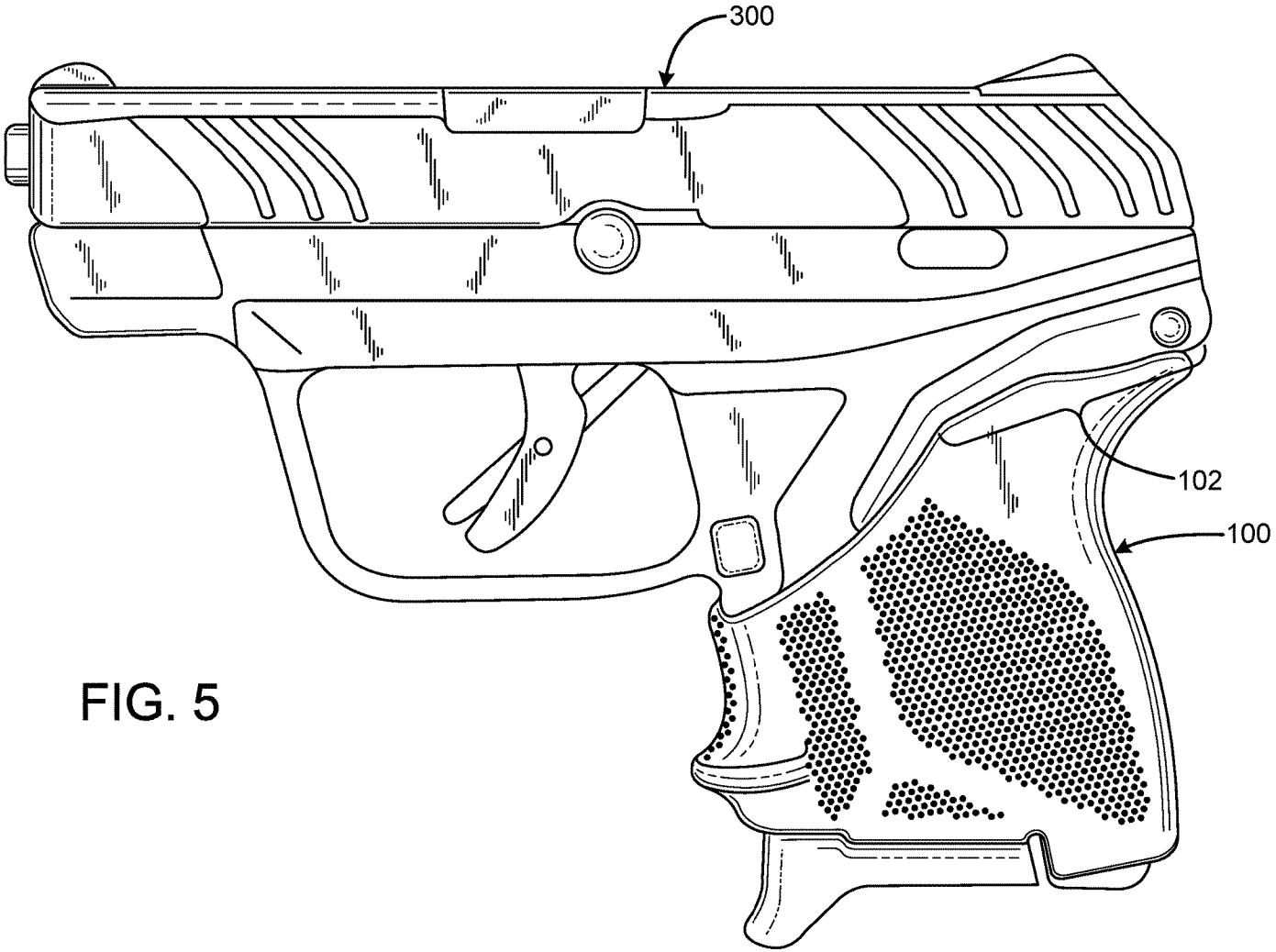
FIG. 5 is a left side view of a first alternative embodiment of the firearm beavertail grip sleeve installed on a Ruger LCP-II pistol.
Figure 6:
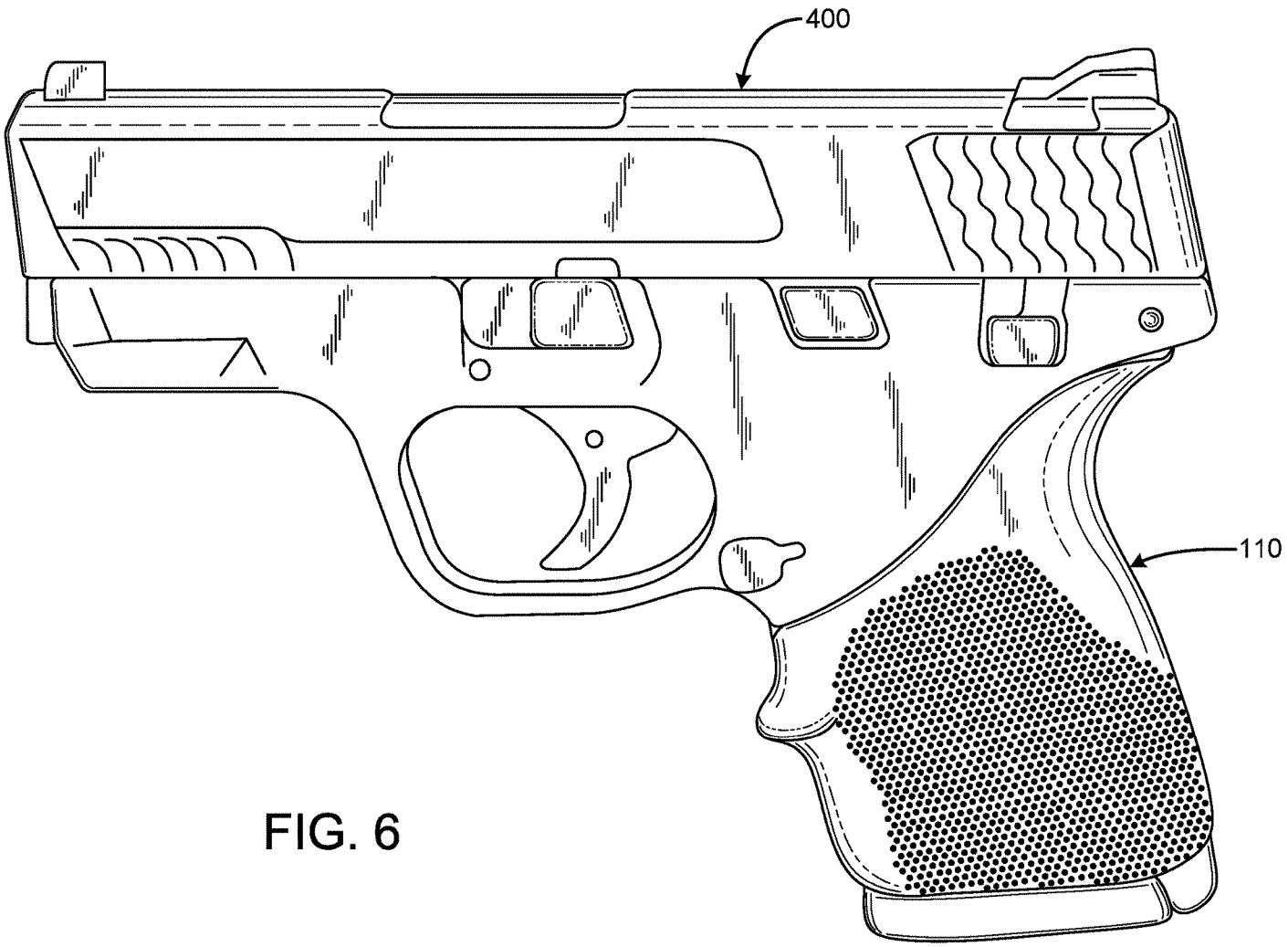
FIG. 6 is a left side view of a second alternative embodiment of the firearm beavertail grip sleeve installed on a Smith & Wesson M&P pistol.
Figure 7:
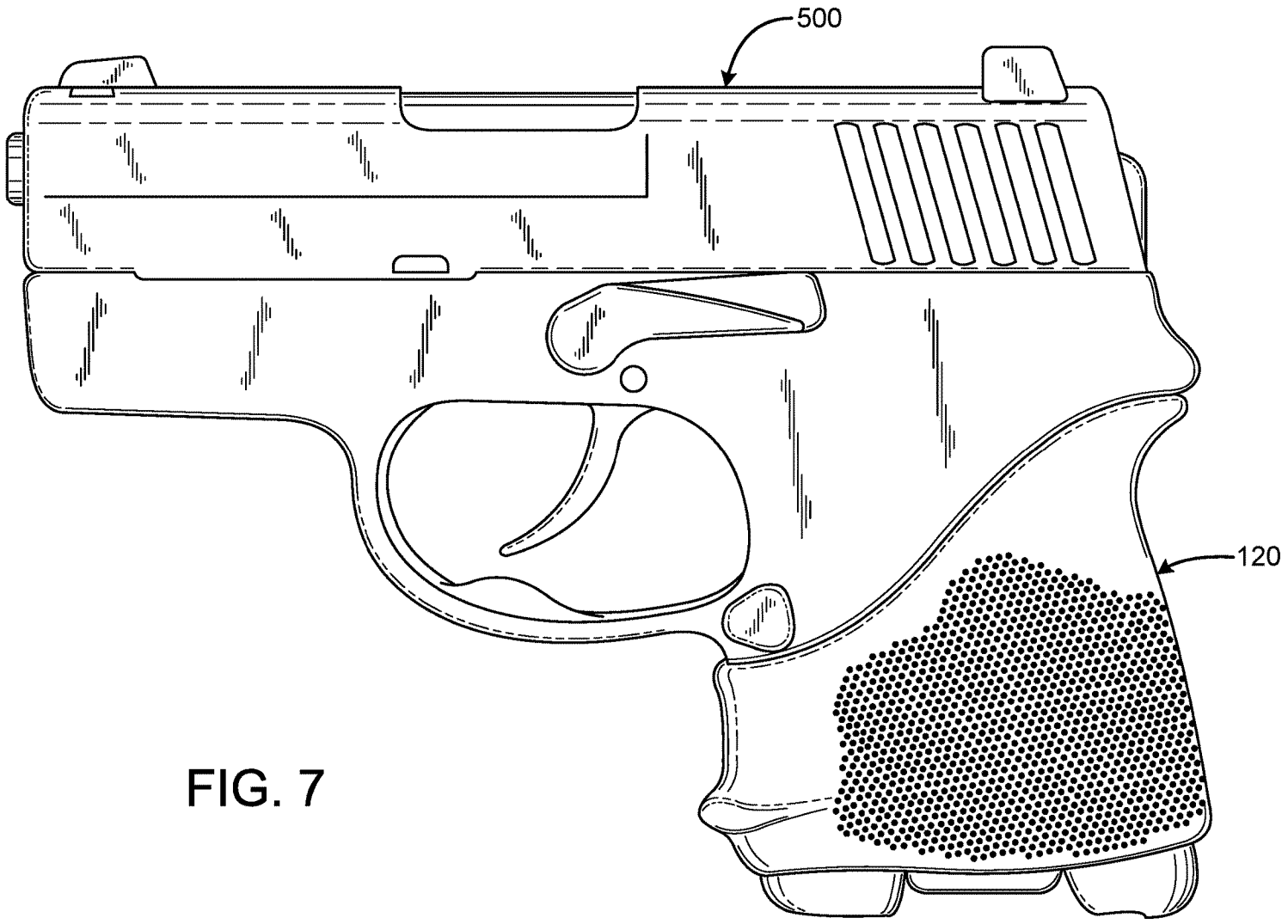
FIG. 7 is a left side view of a third alternative embodiment of the firearm beavertail grip sleeve installed on a Sig Sauer pistol.

FIGS. 5-7 illustrate first, second, and third embodiments 100, 110, 120 of the firearm beavertail grip sleeve. Just like a conventional elastomeric grip that leaves the beavertail area uncovered, the firearm beavertail grip sleeve that covers the beavertail extension portion of the host pistol universally adapts to many firearm grip shape variations for both handguns and rifle grips. Sleeve 100 is shown installed on a Ruger® LCP-II pistol 300 manufactured by Sturm, Ruger & Co., Inc. of Newport, N.H. Sleeve 110 is shown installed on a Smith & Wesson M&P® pistol 400 manufactured by Smith & Wesson of Springfield, Mass. Sleeve 120 is shown installed on a pistol 500 manufactured by Sig Sauer, Inc. of Newington, N.H. It should be appreciated that the articulated line portion 102 of sleeve 100 is effectively convex. To customize the firearm beavertail grip sleeve to a specific firearm, the grip of that firearm is measured and taken into consideration. Both the size and the curvature of the firearm's grip shape determines the parameters of the associated grip sleeve. The customized grip typically has a 0.00-0.300 inch stretch per side in the firearm/rifle grip region. This allows a range of minimal to maximum acceptable stretch of the grip sleeve for a resiliency retention fit as well as facilitating installation of the grip sleeve on the host firearm. The multiple complex varying side wall surfaces that transition thick to thin and back to thick again are determined by the grip shape of the host firearm/rifle grip. Because it is difficult to get the rear edge portion to fit tightly with its own resiliency against the beavertail protrusion area of the host firearm, the shapes of the side wall surfaces are carefully sized to ensure the rear edge portion and the spine in the rear wall fit tightly against the grip of the host firearm. The rear edge portion can have −5° to -40° of intrusion to the grip tang region as the rear edge portion conforms to the beavertail region of the host firearm to ensure the rear edge portion remains taut.

The features of sleeves 100, 110, 120 have the same functions as the corresponding features of the previously described sleeve 10, so no further description is needed. Furthermore, the features of pistols 300, 400, 500 have the same functions as the corresponding features of the previously described pistol 200, so no further description will be provided.

In the context of the specification, the terms "rear" and "rearward," and "front" and "forward," have the following definitions: "rear" or "rearward" means in the direction away from the muzzle of the firearm while "front" or "forward" means it is in the direction towards the muzzle of the firearm.

While a current embodiment of a firearm beavertail grip sleeve has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, while the pistols as described are the most likely contemplated application for the concepts of the present invention, it should be appreciated that the current invention could be used with any firearm grip, including revolvers and rifles such as AR-15s, as well as hand and power tools and other implements with a handgrip.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A grip sleeve for a firearm having a barrel defining a horizontal axis and a perpendicular vertical axis, a frame having a grip with a lower free end and a trigger guard forward of the grip, the grip having a front surface and a back surface having an upper portion that curves in a rearward direction, the grip sleeve comprising:

a tubular body having a front wall, a left side wall, a right side wall, and a rear wall;

the tubular body being of an elastomeric material;

the tubular body having a lower end associated with the lower free end of the pistol grip, and an opposed upper end;

the upper end of the tubular body having a front edge portion at the front wall at a limited first vertical distance above the lower end;

the upper end of the tubular body having a rear edge portion at the rear wall at a second vertical distance above the lower end greater than the first vertical distance;

at least an upper guard element at the upper end of the rear edge portion curving back in an upward and rearward direction;

wherein an upper portion of the rear wall including the upper guard element has a forward arcuate surface adapted to contact the upper portion of the back surface of the grip and has a concave rear arcuate profile;

the upper portion of the rear wall having a first forward portion having a thickness;

the upper portion of the rear wall having a second upper end tapering upward and rearward to a second thickness less than the first thickness; and the upper portion of the rear wall having a third lower end tapering downward and rearward to a third thickness less than the first thickness.

2. The grip sleeve of claim 1 wherein the upper guard element having a guard surface facing in a direction angularly rearward and downward.

3. The grip sleeve of claim 1 wherein the upper guard element is a saddle shape having a positive curvature.

4. The grip sleeve of claim 1 wherein the upper end has an upper perimeter forward of the upper guard element having a convex curvature adjacent to the upper guard element and a concave curvature away from the upper guard element.

5. The grip sleeve of claim 1 wherein the tubular body is free of holes other than a passage defined by the tubular body.

6. The grip sleeve of claim 1 wherein the tubular body is entirely formed only of an elastomeric material.

7. The grip sleeve of claim 1 wherein the tubular body is formed of a single material.

8. The grip sleeve of claim 1 wherein the front edge portion is spaced below the trigger guard to enable a finger below the trigger guard to contact the grip below the trigger guard.

9. The grip sleeve of claim 1 wherein the tubular body defines a linear grip passage defining a magazine insertion axis, and wherein the upper guard element extends farther upward along the magazine insertion axis than does the front edge portion.

10. The grip sleeve of claim 1 wherein the trigger guard defines an opening having an upper limit, and wherein the upper guard element extends vertically to a level above the upper limit of the trigger guard opening.

11. The grip sleeve of claim 1 wherein the rear wall has a rear surface with a lower portion angling downward and rearward, a curved transition above the lower portion, and an upper portion extending upward and rearward from the curved transition.

12. The grip sleeve of claim 11 wherein the curved transition and the upper portion are a continuous curved surface.

13. A grip sleeve for a firearm having a beavertail frame element extending rearward from and above a forward rear grip surface, the grip sleeve comprising:

a tubular elongated body formed entirely of a unitary elastomeric material;

the tubular elongated body having a front wall, a left side wall, a right side wall, and a rear wall;

an upper edge of the tubular elongated body having a front edge portion at the front wall;

the upper edge of the tubular elongated body having a rear edge portion at the rear wall at a level above the front edge portion;

the rear edge portion configured to overlay at least a portion of the beavertail frame element; and wherein an upper portion of the rear wall including the upper edge of the tubular elongated body has a forward arcuate surface adapted to contact the beavertail frame element and has a concave rear arcuate profile;

the upper portion of the rear wall having a first forward portion having a first thickness; the upper portion of the rear wall having a second upper end tapering upward and rearward to a second thickness less than the first thickness; and the upper portion of the rear wall having a third lower end tapering downward and rearward to a third thickness less than the first thickness.

14. The grip sleeve of claim 13 wherein the rear edge portion is below at least a portion of the beavertail frame element.

15. The grip sleeve of claim 13 wherein the rear edge portion has an upper surface abutting the beavertail frame element.

16. The grip sleeve of claim 15 wherein the upper surface faces in a direction at least in part upward.

17. The grip sleeve of claim 1 further comprising the forward arcuate surface having a greater radius of curvature than the rear arcuate profile when taken in a medial plane.

18. The grip sleeve of claim 1 further comprising forward arcuate surface and the rear arcuate profile being smooth and continuous arcuate curves when taken in a medial plane.

* * * * *